US005497578A

United States Patent [19]

Wautelet et al.

[11] Patent Number: 5,497,578

[45] Date of Patent: Mar. 12, 1996

[54] WINDOW REGULATOR WITH CUSHIONED UP STOP

[75] Inventors: René J. Wautelet, Milford; William R. Tacker, Auburn Hills; John A. Kubiak, Sterling Heights, all of Mich.

[73] Assignee: Rockwell International Corporation, Pittsburgh, Pa.

[21] Appl. No.: 319,560

[22] Filed: Oct. 7, 1994

[51] Int. Cl.[6] ..... E05F 11/44

[52] U.S. Cl. ..... 49/349; 49/350; 49/351; 49/375

[58] Field of Search ..... 49/349, 350, 351, 49/375, 376

[56] References Cited

U.S. PATENT DOCUMENTS

| | | | |
|---|---|---|---|
| 4,495,827 | 1/1985 | Parizet | 49/350 X |
| 4,777,766 | 10/1988 | Johnson et al. | 49/351 |
| 4,924,627 | 5/1990 | Lam et al. | 49/351 |
| 4,986,029 | 1/1991 | Richter | 49/349 |
| 5,027,555 | 7/1991 | Halliwell | 49/376 X |

*Primary Examiner*—Philip C. Kannan

[57] ABSTRACT

A cross-arm window regulator for moving a window between raised, intermediate and lowered positions in a vehicle door, includes a resilient stop cushion housed in the lift channel mounted on the glass. Sliders mounted on the ends of the lift and cross arms engage the ends of the cushion as the window nears raised position, gradually compressing it to cushion window movement to raised position. If the geometry is the same for raised and lowered positions, the same cushioning will also occur in the window lowered position. The spring rate increases as compression occurs. The cushion can be a foam butyl rubber strip or a metal spring of various types. The spring rate can be tailored by making the cushion a dual density foam strip, a foam strip with holes of varying sizes to provide a variable cross-section, or a coated foam strip. An integral stop can be included in the form of a hard plastic shell for the foam strip or spring. A similar single arm regulator includes a foam extension on either side of the single slider for compression against spaced tabs in the channel. Alternatively, an extension or compression spring can be used for cushioning.

20 Claims, 6 Drawing Sheets

FIG 1
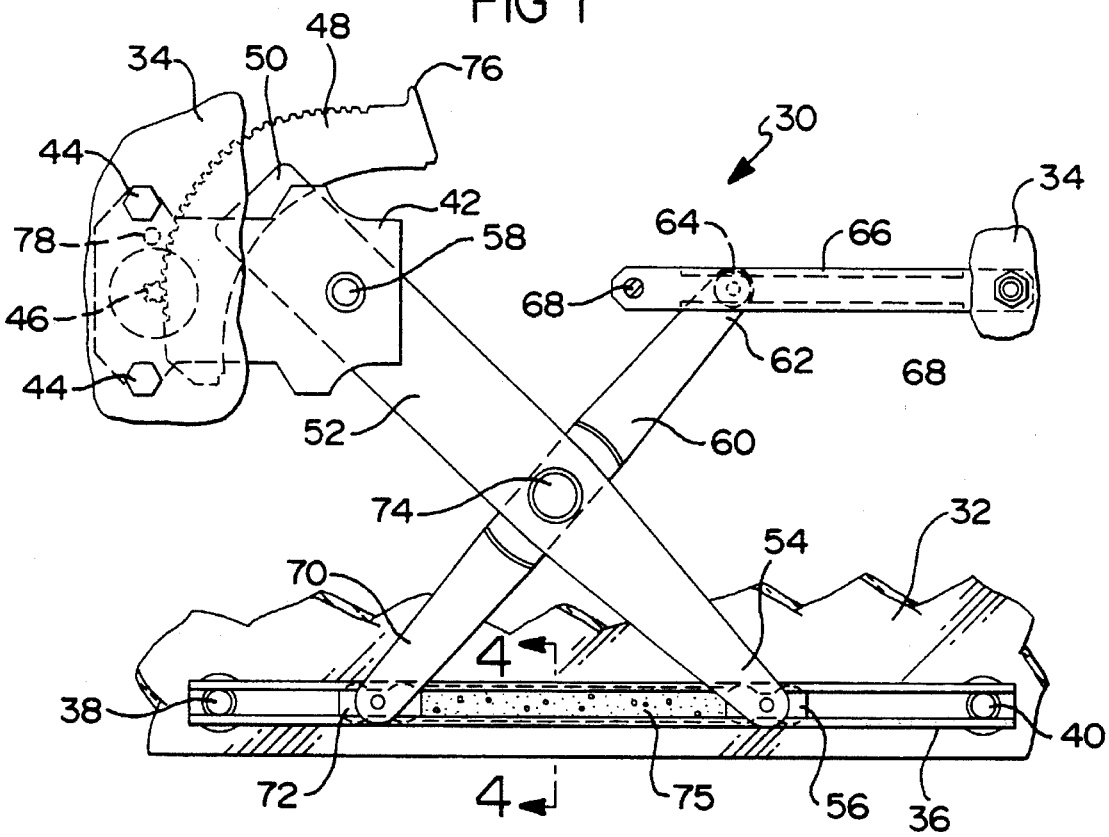
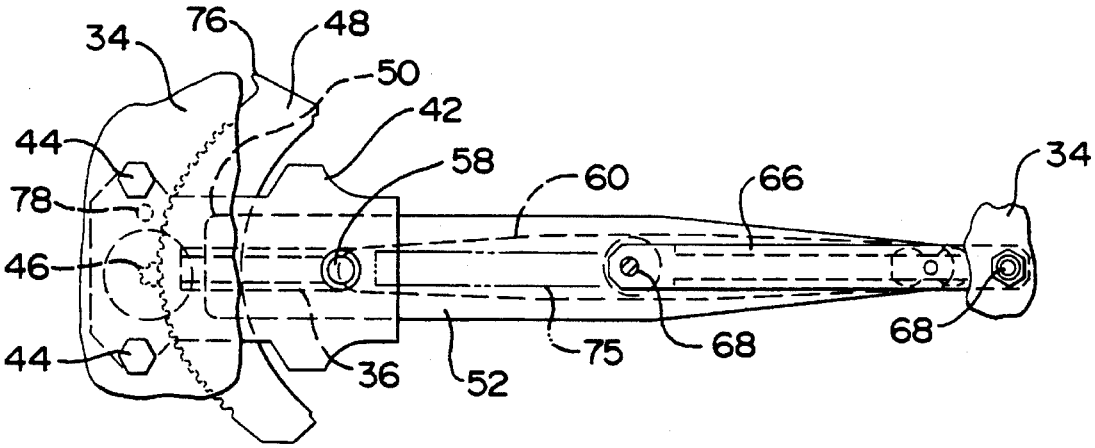
FIG 2

FIG 3
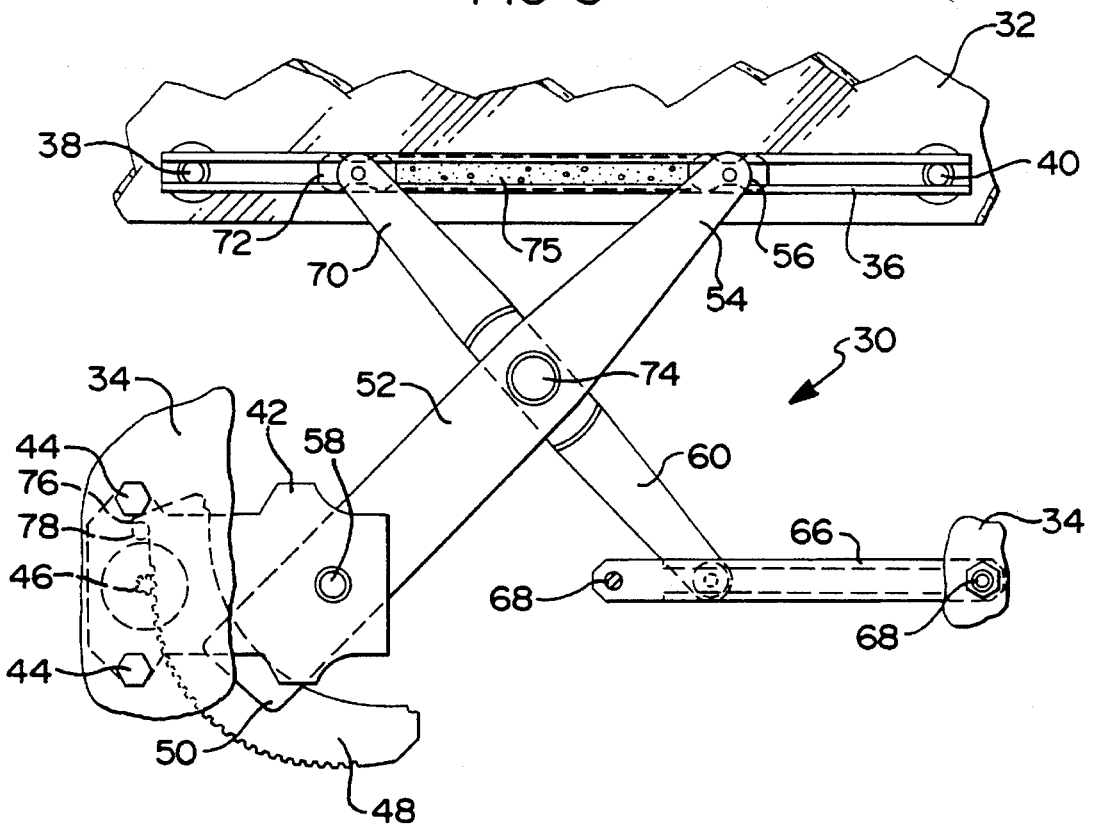
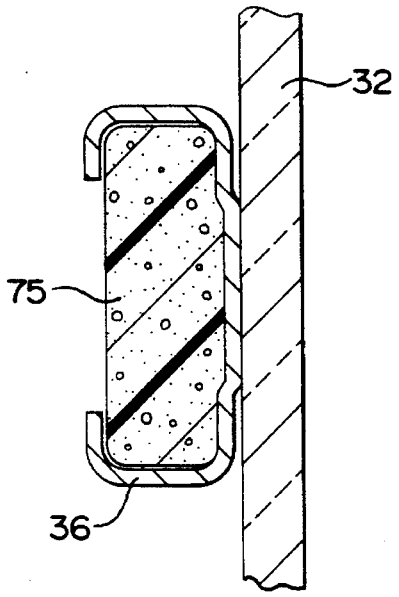
FIG 4

FIG 17
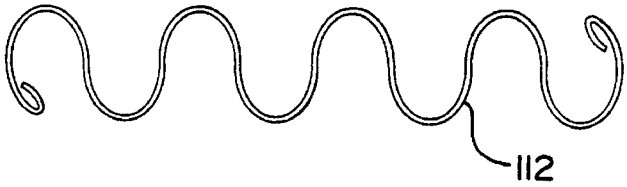
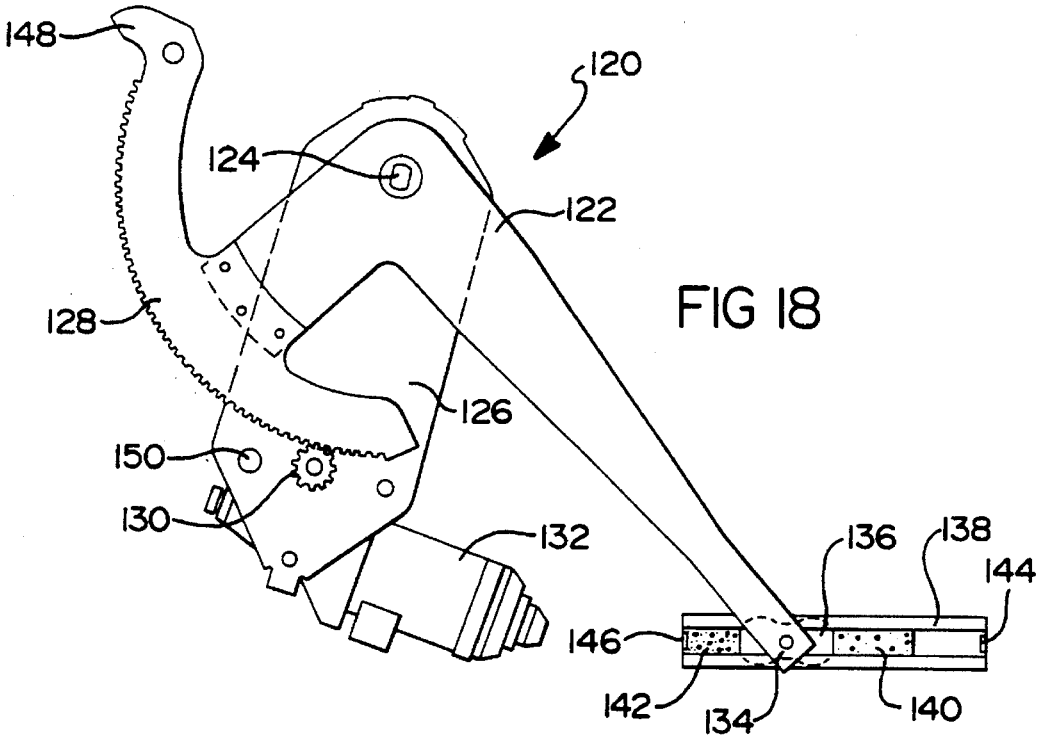
FIG 18
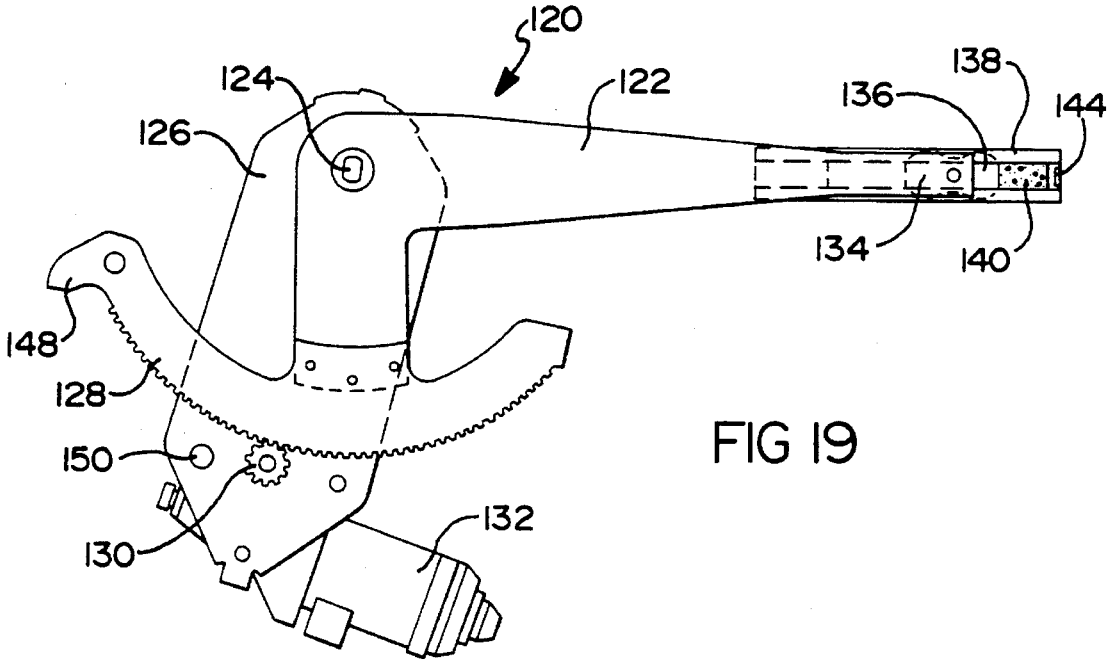
FIG 19

WINDOW REGULATOR WITH CUSHIONED UP STOP

BACKGROUND OF THE INVENTION

This invention relates generally to power-operated cross-arm and single arm window regulators for raising and lowering vehicle windows and, more particularly, to a device for cushioning movement of windows by such regulators to raised position.

Single arm and cross-arm window regulators have been in widespread use in vehicles for decades. Both comprise welded metal assemblies in which one end of a pivotable lift arm mounts a gear sector which is driven by a pinion. The other end of the lift arm mounts a roller or other slider which slides in a glass-mounted channel as the arm is raised and lowered to raise and lower the window. The cross-arm regulator adds a force-stabilizing equalizer arm pivoted to the lift arm which mounts a slider on both ends —one slidable in the window channel and the other slidable in a fixed channel. The equalizer arm scissors on the lift arm to equalize the forces tending to tilt a window as it is raised and lowered by the lift arm.

The lift arm is driven up and down by a driving pinion which engages a sector mounted on the inner end of the lift arm. In years past, the drive pinion of these regulators has been operated by a manual crank. Gradually, these "manual windows" have been displaced by "power windows" in an increasing variety of vehicles. These power windows replace the manual crank with an electric torque motor-powered operator to drive the pinion. Currently, these drive motors are operated by manual switches located in the passenger compartment.

Both the raised and lowered positions for the windows can be defined in many ways. In one power window application, the window raised position is defined by engagement of a stop surface on the sector arm with a cooperating stop surface, such as the drive pinion or the motor housing or other structure. Upon engagement of these stop surfaces, window movement halts. If the manual switch is not released when the window reaches raised position, the motor will continue to run until it overloads and stalls out.

A problem has been encountered with this power window arrangement. As the window nears raised position, it engages a window seal, which provides some varying resistance to completion of window movement to fully closed position. The resistance encountered can vary greatly, depending on vehicle build tolerances and vehicle seal type, which varies for framed or frameless windows. If sufficient resistance is encountered, the drive motor will stall out prematurely, before the window reaches fully raised position.

The window regulator test specifications established by the vehicle manufacturer will determine the output required of the drive motor. Higher output of the motor produces higher impact forces on the window regulator, especially in the fully up and down window positions. In vehicles where little seal resistance is encountered, the arm stop surface engages the operator stop surface with a significant impact force. In certain cases, this repeated and unrestrained impact can have a significant effect on the structural integrity of the window regulator and can even result in breakage of welds and component parts.

It would be desirable to provide some means to cushion the final movement of the window to raised position to reduce the impact force imposed on the component parts of the window regulator.

It would also be desirable to provide resilient cushioning means located in the window lift channel which are increasingly stressed by movement of the slider to window raised position.

SUMMARY OF THE INVENTION

It is therefore an object of this invention to provide some means to cushion the final movement of the window to raised position to reduce the impact force imposed on the component parts of the window regulator.

Another object of this invention is to provide resilient cushioning means located in the window lift channel which are increasingly stressed by movement of the slider to window raised position.

In one aspect, this invention features a window regulator for moving a window between raised and lowered positions in a vehicle door which comprises a lift channel mounted adjacent the lower edge of the window having a slider slidable in the lift channel as the window is moved between positions. A lift arm mounts the slider at one end and a power operator mounted on the door is in operative engagement with the other end of the lift arm to raise and lower the lift arm to move the window. Cooperating stop surfaces on the operator and on the arm are interengageable to define the window raised position. Resilient means located in the lift channel are increasingly stressed by the slider as the window approaches raised position to cushion the impact of engagement of the stop surfaces as the window reaches raised position.

In another aspect, this invention features a channel which includes an abutment mounted on the lift channel and the resilient means are an elastomeric strip which is compressed between the abutment and the slider.

In yet another aspect, this invention features resilient means which include a rigid housing in the lift channel, and a resilient member slidably housed within the housing and having a free end engageable and compressible by the slider until the slider engages the housing to stop slider movement.

In still another aspect, this invention features a cross arm pivoted to the lift arm intermediate the arm ends, a second slider mounted on one end of the cross arm for sliding movement in the lift channel, a fixed channel mounted on the door, and a third slider mounted on the other end of the cross arm for sliding movement in the fixed channel, wherein the resilient means are compressed between the first and second sliders as the window approaches raised position.

In a further aspect, this invention features the power operator which includes a stop surface engageable by the lift arm in window raised position, whereby stressing of the resilient means by the sliders cushions the impact of the lift arm with the stop surface.

These and further objects and features of this invention will become more readily apparent upon reference to the following detailed description of a preferred embodiment, as illustrated in the accompanying drawings, in which:

BRIEF DESCRIPTION OF THE DRAWINGS

FIG. 1 is a side view of a cross-arm window regulator according to this invention, illustrated in window lowered position;

FIG. 2 is a view similar to FIG. 1, illustrating the window regulator in intermediate position;

FIG. 3 is a view similar to FIG. 1, illustrating the window regulator in raised position;

FIG. 4 is an enlarged sectional detail view, taken along line 4—4 of FIG. 1;

FIG. 17 is a perspective view of a still further embodiment of a stop cushion according to this invention;

FIG. 18 is a side view of a single arm window regulator according to this invention, illustrated in window lowered position;

FIG. 19 is a view similar to FIG. 18, illustrating the window regulator in intermediate position;

DETAILED DESCRIPTION OF A PREFERRED EMBODIMENT

Figure 5:
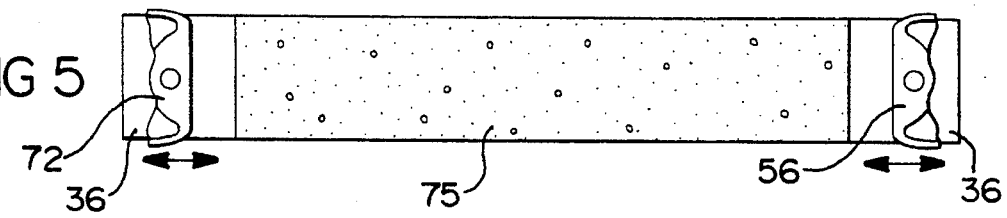
FIGS. 5–10 are enlarged detail views of the stop cushion showing operation sequentially from window intermediate position, through window raised to window intermediate to window lowered position.

FIGS. 1–4 of the drawings show a window regulator 30, according to this invention, for raising and lowering a window glass panel 32 between raised and lowered positions in a vehicle door, a structural portion 34 of which is illustrated, as is well-known. A conventional C-shaped lift channel 36 is mounted adjacent the lower edge of window 32 by conventional fasteners 38 and 40.

Window regulator 30 comprises an electric drive motor 42 which is mounted on door structure 34 by bolts 44. Drive motor 42 has an output pinion 46 in driving engagement with a gear sector 48 that is welded to one end 50 of a lift arm 52. The other end 54 of lift arm 52 pivotally mounts a plastic slider 56 that is slidably captured in channel 36. Lift arm has a pivotal connection 58 to the housing of motor 42.

Figure 11:
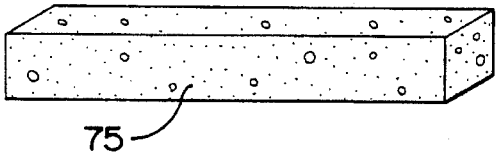
FIG. 11 is a perspective view of the stop cushion of FIGS. 1–10.

An equalizer arm 60 has one end 62 pivotally mounting a slider 64 that is slidably captured in another C-shaped channel 66 which is mounted by bolts 68 to door structure 34. The other end 70 of equalizer arm 60 pivotally mounts a plastic slider 72 that is also slidably captured in channel 36. Equalizer arm 60 is pivotally mounted at 74 to lift arm 52. A resilient stop cushion or spring means 75, shown in FIG. 11, is located in channel 36 between sliders 56 and 72, as best seen in FIG. 4 for a purpose now to be described.

Operation of motor 42 rotates pinion 46 to drive sector 48 and lift arm 52 about pivot 58. This moves window 32 from its lowered position of FIG. 1, through the intermediate position of FIG. 2 to the raised position of FIG. 3. Window 32 is located in its FIG. 3 raised position by engagement of an enlarged stop tooth 76 mounted on the upper end of lift arm 48 with a stop abutment 78 on the housing of motor 42, which together comprise a mechanical stop.

Figure 6:
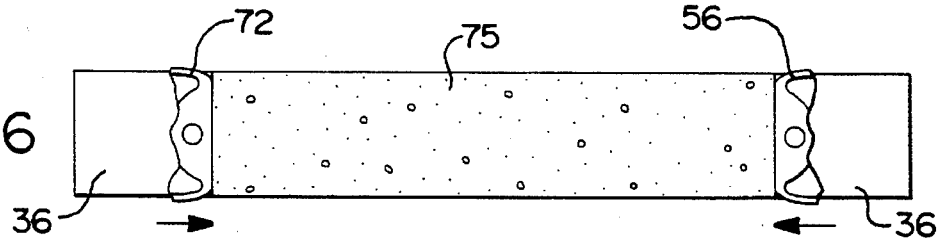
Figure 7:
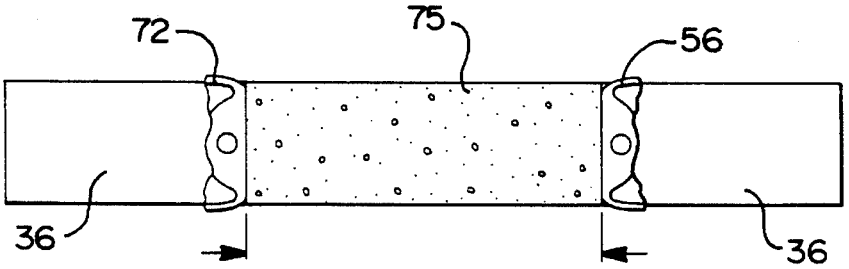

During this raising movement, sliders 56 and 72 move apart and then together, as illustrated and in a well-known manner. As can be seen from FIGS. 1, 3, 5, 6 and 7, stop cushion 75 is increasingly compressed between sliders 56 and 72 upon window movement from the FIGS. 2 and 5 intermediate position, through the partially raised position of FIG. 6, to the fully raised position of FIGS. 3 and 7. This increasing compression of stop cushion 72 provides an increasing resistance to window movement to fully raised position.

The compression of stop cushion 75 cushions the impact of tooth 76 with stop abutment 78. The cushioning effect produced is dependent on the physical characteristics and dimensions of stop cushion 75 and the force needed to overcome the door-mounted sealing strip resistance. The designer will chose whatever material and dimensions of stop cushion 75 needed to provide the cushioning effect desired for any particular installation. Stop cushion 75 provides impact cushioning, while assuring that window 32 will reach fully raised position.

Figure 8:
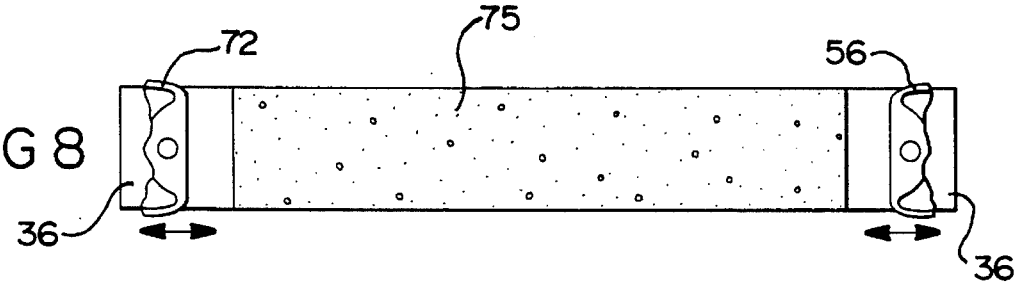
Figure 9:
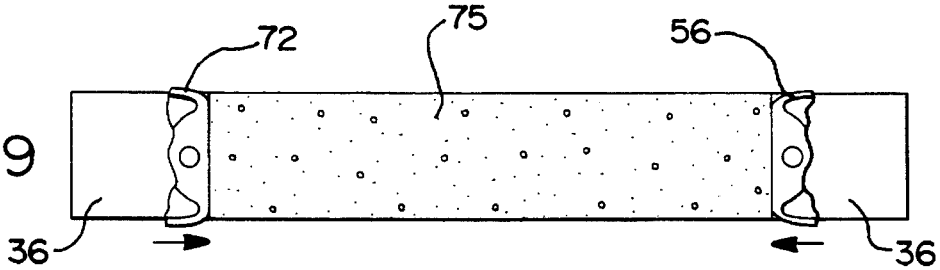
Figure 10:
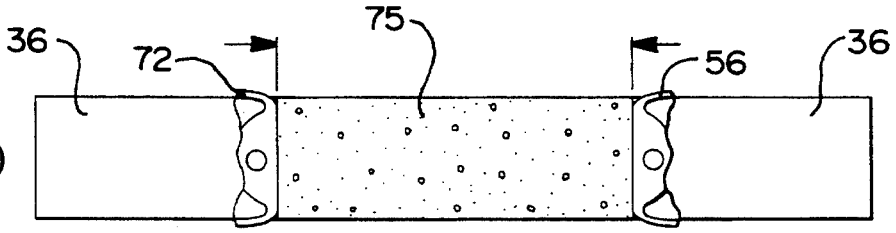

FIGS. 8–10 illustrate operation and compression of stop cushion 75 during window movement from intermediate FIG. 8 position, through the partially lowered FIG. 9 position, to the fully lowered position of FIG. 10. No mechanical stop, like the engagement of tooth 76 with stop abutment 78, is normally provided as a down stop and the seal resistance problem is not encountered. Whether a down stop is utilized or not is determined by the specific geometry of pinion/sector gear ratio, and lift arm length. In this invention, the absence or presence of the compression of stop cushion 75 upon downward window movement is not relevant. It is the cushioning of movement to fully raised position that reduces the impact of the mechanical stop.

Stop cushion 75 is preferably an elastomeric strip such as closed cell butyl rubber and is lubricated to facilitate movement of the strip in channel 36. Other configurations and materials can be used in substitution of stop cushion 75 and are illustrated in FIGS. 11–17.

Figure 12:
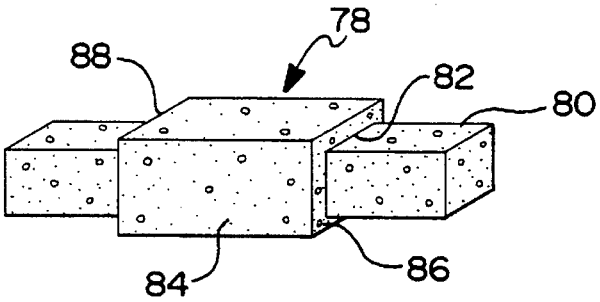
FIG. 12 is a perspective view of another embodiment of a stop cushion according to this invention.

Another form of stop cushion 78 is shown in FIG. 12, where a similar rubber strip 80 is mounted in a central channel 82 of a hard plastic or rubber shell 84. Strip 80 is compressed within channel 82 by sliders 56 and 72 until the sliders engage the end surfaces 86 and 88 of shell 84. Stop cushion is useful in a window regulator not having the mechanical up stop 76, 78 of FIGS. 1–3 to provide a positive up stop.

Figure 13:
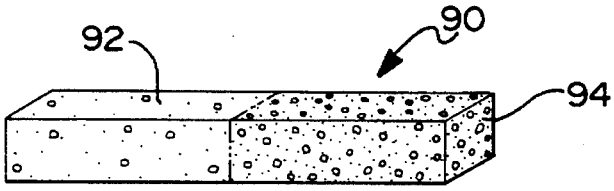
FIG. 13 is a perspective view of yet another embodiment of a stop cushion according to this invention.

FIG. 13 shows a dual density rubber stop cushion 90 comprising a low density segment 92 and a higher density segment 94. In operation, segment 92 would compress until it is as dense as segment 94, whereupon both segments would compress at the same rate. An advantage of this dual density arrangement is a terminal rapid increase in resistance per unit of travel by sliders 56 and 72, ending in a compression that produces a resistance sufficient to stall motor 42.

Figure 14:
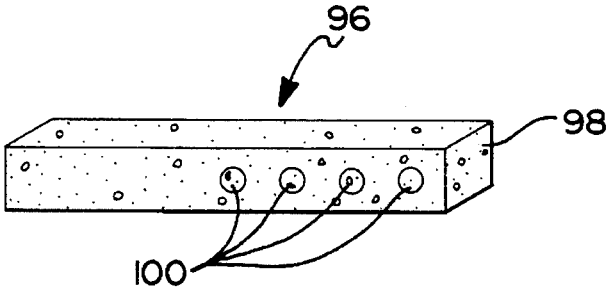
FIG. 14 is a perspective view of still another embodiment of a stop cushion according to this invention.

FIG. 14 illustrates a dual rate cushion 96 comprising a strip 98 made of the same material as cushions 75, 80 and 90. Strip 98 includes a segment having through holes 100, which produces a cushion that functions in the same dual rate manner as cushion 90, with the "holey" section compressing until it reaches the same density as the solid segment.

Figure 15:
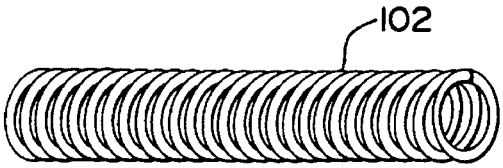
FIG. 15 is a perspective view of a further embodiment of a stop cushion according to this invention.
Figure 16:
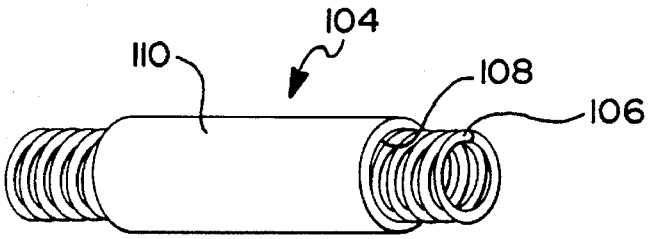
FIG. 16 is a perspective view of a yet further embodiment of a stop cushion according to this invention.

FIG. 15 shows a cushion 102 comprising a conventional coil spring, which would require an adapter for confinement in channel 36. FIG. 16 shows a dual rate coil spring cushion 104, comprising a coil spring 106 that is confined within a central opening 108 in a hard plastic shell 110. Dual rate cushion operates in the same manner as cushion 90. FIG. 17 illustrates a sinuous steel spring 112 which will operate much as spring 102, but is more readily adapted to confinement within lift channel 36.

Figure 20:
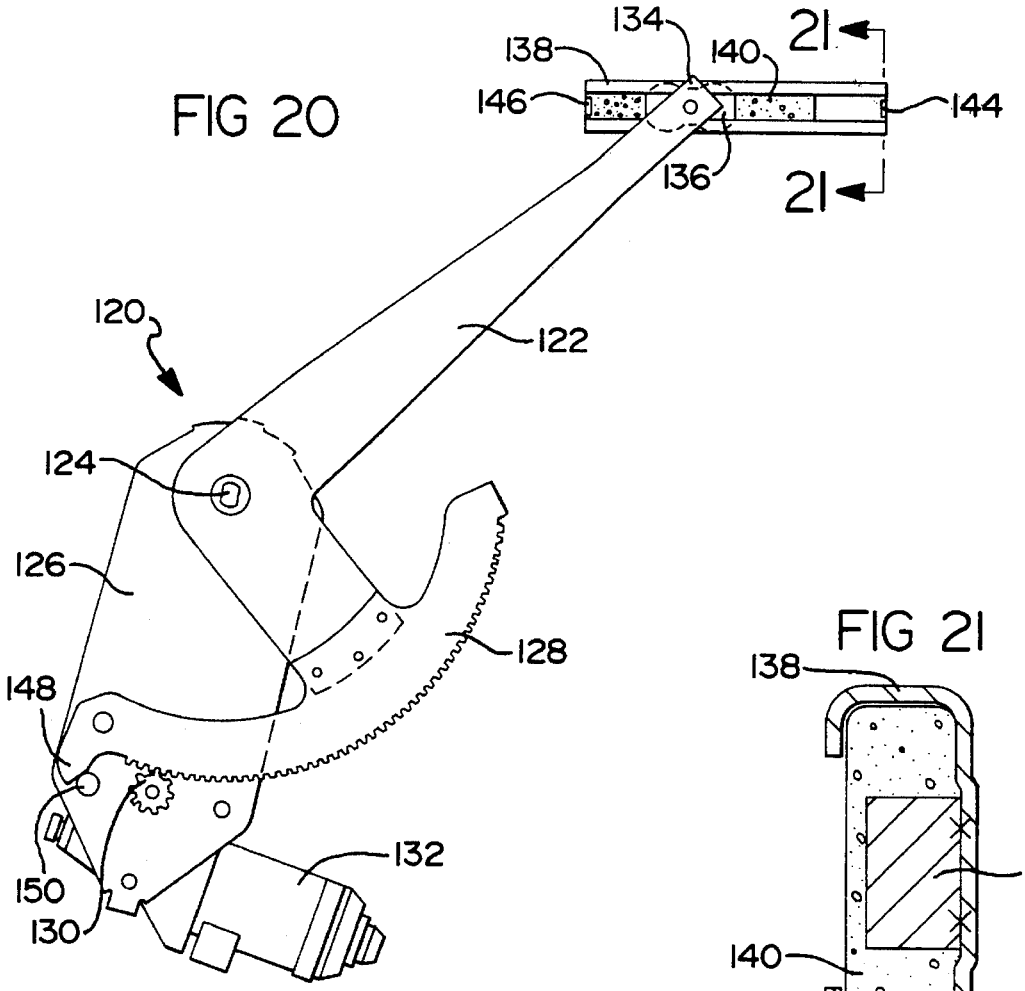
FIG. 20 is a view similar to FIG. 18, illustrating the window regulator in raised position.
Figure 21:
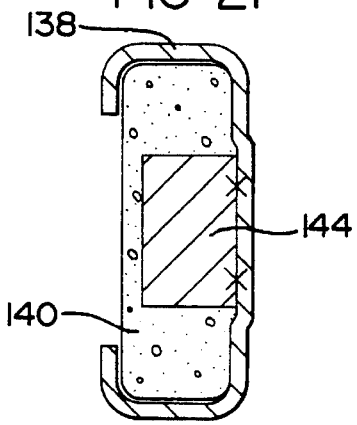
FIG. 21 is an enlarged sectional detail view, taken along lines 21—21 of FIG. 20.

FIGS. 18–20 illustrate a single arm window regulator 120 according to this invention. A lift arm 122 is pivoted at 124 to a vehicle door-mounted mounting bracket 126. A gear sector 128 is attached to lift arm 122 and engages output pinion 130 of drive motor 132, which is mounted on door mounting bracket 126. The other end 134 of lift arm 122 pivotally mounts a plastic slider 136 that is slidable in a C-shaped channel 138, that is mounted on the lower edge of a pane of glass (not shown), in the same manner as the FIG. 1–3 embodiment.

Figure 22:
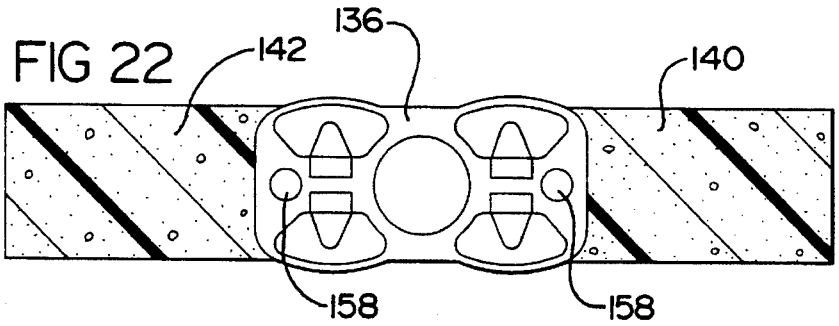
FIG. 22 is an enlarged side view of the stop cushion of FIGS. 18–20.

Slider 136 has closed cell rubber stop cushions 140 and 142 mounted on its ends, as shown in FIG. 22. Channel 138 has a pair of stops 144 and 146 welded to either end to confine slider 136. Operation of motor 132 will pivot lift arm to raise channel 136 from the window-lowered FIG. 18 position, through the FIG. 19 intermediate position to the FIG. 20 window raised position. An enlarged stop tooth 148 engages a stop abutment 150 mounted on bracket 126, as shown in FIG. 20.

As window regulator 120 moves from the FIG. 19 intermediate position to the FIG. 20 raised position, lift arm 122 will contact the end of cushion strip 142 with channel stop 146 and gradually compress it. This provides increasing resistance to lift arm movement to increasingly cushion engagement of stop tooth 148 with stop abutment 150. As illustrated, cushion strip 140 never engages stop 144. These elements are provided to make slider 136 and channel 138 symmetrical to enable mounting on either left or right vehicle doors.

Figure 23:
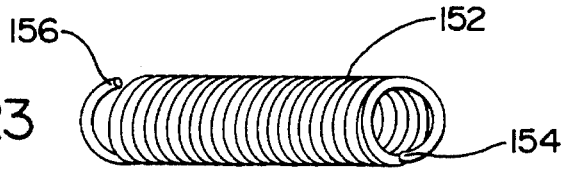
FIG. 23 is a perspective view of another embodiment of a stop cushion used with a single arm window regulator according to this invention.

FIG. 23 shows another form of cushion 152 in the form of a tension spring which is useful with single arm window regulator 120. In this embodiment, the rubber cushion strips 140 and 142 are removed from slider 136. One end 154 of spring 152 is connected to stop 144 and the other end 156 is connected through one of the holes 158 in slider 136. In operation, spring 152 will be tensioned upon movement of window regulator 120 from intermediate to raised position.

Thus, this invention provides some means to cushion the final movement of a vehicle window to raised position to reduce the impact force imposed on the component parts of the window regulator, and provides resilient cushioning means located in the window lift channel which are increasingly stressed by movement of the slider to window raised position.

While only a preferred and other embodiments have been illustrated and described, obvious modifications thereof are contemplated within the scope of this invention and the following claims.

I claim:

1. A window regulator for moving a window between raised and lowered positions in a vehicle door, comprising a lift channel mounted adjacent the lower edge of the window, a slider slidable in the lift channel as the window is moved between positions, a lift arm having one end mounting the slider, a power operator mounted on the door in operative engagement with the lift arm other end for raising and lowering the lift arm to move the window, cooperating stop surfaces on the operator and on the arm which are interengageable to define the window raised position, and spring means located in the lift channel which are increasingly stressed by the slider as the window approaches raised position to cushion the impact of engagement of the stop surfaces as the window reaches raised position.

2. The window regulator of claim 1, wherein the spring means is an elastomeric strip which is compressed by the slider.

3. The window regulator of claim 2, wherein the elastomeric strip has internal voids sized to provide a predetermined spring rate for cushioning window movement to raised position.

4. The window regulator of claim 2, wherein the spring means include an abutment mounted on the lift channel and the elastomeric strip is compressed between the abutment and the slider.

5. The window regulator of claim 4, wherein the elastomeric strip is attached to the slider for movement therewith.

6. The window regulator of claim 1, wherein the spring means include a rigid housing in the lift channel, and a resilient member slidably housed within the housing and having a free end engageable and compressible by the slider until the slider engages the housing to stop slider movement.

7. The window regulator of claim 1, including a cross arm pivoted to the lift arm intermediate their ends, a second slider mounted on one end of the cross arm for sliding movement in the lift channel, a fixed channel mounted on the door, and a third slider mounted on the other end of the cross arm for sliding movement in the fixed channel, wherein the spring means are compressed between the first and second sliders as the window approaches raised position.

8. A cross-arm window regulator for moving a window between raised, intermediate and lowered positions in a vehicle door, comprising a lift channel mounted adjacent the lower edge of the window, first and second sliders slidable in the lift channel, a lift arm having an inner end mounting a gear sector and an outer end mounting the first slider, an operator mounted on the door having a drive pinion in operative engagement with the gear sector for raising and lowering the lift arm, a fixed channel mounted on the door, an equalizer arm having one end slidably mounted in the fixed channel and mounting the second slider on its other end, a pivot pin pivotally interconnecting both arms intermediate their ends, whereby movement of the lift arm by the operator to raise the lift arm moves the sliders away from each other as the window moves from lowered to intermediate position and moves the sliders toward each other as the window moves to raised position, and spring means located in the lift channel having free ends increasingly stressable by both sliders as the window approaches raised position to cushion window movement to raised position.

9. The window regulator of claim 8, wherein the spring means is an elastomeric strip.

10. The window regulator of claim 9, wherein the elastomeric strip has internal voids sized to provide a predetermined spring rate for cushioning window movement to raised position.

11. The window regulator of claim 8, wherein the spring means include a rigid housing in the channel, and a resilient member slidably housed within the housing and having its free ends extending therefrom for engagement and compression by the sliders until the slider engages the housing to stop slider movement.

12. The window regulator of claim 11, wherein the spring means comprises a compression spring.

13. The window regulator of claim 12, wherein the spring is a coil spring.

14. The window regulator of claim 8, wherein the spring means is a foam rubber strip.

15. The window regulator of claim 14, wherein the foam rubber strip comprises two segments, one of which has a different spring rate than the other segment.

16. The window regulator of claim 8, wherein the operator is a power operator driving the drive pinion and having a stop abutment, and the sector includes a stop surface which engages the stop abutment in window raised position, whereby stressing of the spring means by the sliders cushions the impact of the stop surface with the stop abutment.

17. The window regulator of claim 16, wherein movement of the lift arm by the operator to lower the lift arm moves the sliders away from each other as the window moves from raised to intermediate position and moves the sliders toward each other as the window moves to lowered position, and the spring means free ends are increasingly stressable by both sliders as the window approaches lowered position to cushion window movement to lowered position.

18. The window regulator of claim 17, including stop means carried by spring means interiorly of the free ends which is engageable by the sliders after stressing the spring means to define the window raised and lowered positions.

19. The window regulator of claim 8, including stop means carried by spring means interiorly of the free ends which is engageable by the sliders after stressing the spring means to define the window raised position.

20. The window regulator of claim 8, wherein the operator is powered by an electric motor which is selectively actuatable to initiate window movement and which stalls when a predetermined resisting force is encountered in raised position, and wherein the spring means is increasingly compressed between the sliders as the window approaches raised position.

* * * * *